US009364867B1

(12) United States Patent
Liao

(10) Patent No.: US 9,364,867 B1
(45) Date of Patent: Jun. 14, 2016

(54) CLEANING APPARATUS

(71) Applicant: Nian-Hao Liao, Taichung (TW)

(72) Inventor: Nian-Hao Liao, Taichung (TW)

( * ) Notice: Subject to any disclaimer, the term of this patent is extended or adjusted under 35 U.S.C. 154(b) by 0 days.

(21) Appl. No.: 14/819,992

(22) Filed: Aug. 6, 2015

(51) Int. Cl.

| | |
|---|---|
| ***B08B 9/023*** | (2006.01) |
| ***A46B 13/02*** | (2006.01) |
| ***B08B 1/00*** | (2006.01) |
| ***A46B 5/00*** | (2006.01) |
| ***A46B 7/06*** | (2006.01) |
| ***A46B 7/04*** | (2006.01) |
| ***A46B 13/00*** | (2006.01) |

(52) U.S. Cl.
CPC ..... *B08B 1/002* (2013.01); *A46B 5/0095* (2013.01); *A46B 7/046* (2013.01); *A46B 7/06* (2013.01); *A46B 13/001* (2013.01); *B08B 9/023* (2013.01); *A46B 2200/3013* (2013.01)

(58) Field of Classification Search
CPC ..... B08B 9/023
See application file for complete search history.

(56) References Cited

U.S. PATENT DOCUMENTS

| | | | | |
|---|---|---|---|---|
| 3,266,075 A * | 8/1966 | Conrad | F42B 33/06 | 15/104.03 |
| 5,566,416 A * | 10/1996 | Karls | A46B 9/02 | 15/104.04 |
| 6,813,797 B1 * | 11/2004 | Kadinger | A46B 3/18 | 15/104.04 |
| 8,898,846 B2 * | 12/2014 | Ernster | A61B 19/34 | 15/104.04 |

* cited by examiner

*Primary Examiner* — Randall Chin

(57) ABSTRACT

A cleaning apparatus includes a supporting element, at least one button unit and a cleaning unit. The supporting element includes a space. The button unit is formed on the supporting element by making a U-shaped slit in the supporting element. The U-shaped slit is in communication with the space. The cleaning unit includes a shell, bristle and at least one hook. The shell includes a first end and a second end. The bristle is connected to an internal side of the shell via the first end. The hook extends from the second end of the shell. The hook is inserted in the space of the supporting element and the U-shaped slit of the button unit to engage the cleaning unit with the supporting element. The button unit is operable to move the hook out of the U-shaped slit to allow disengagement of the cleaning unit from the supporting element.

10 Claims, 10 Drawing Sheets

CLEANING APPARATUS

BACKGROUND OF INVENTION

1. Field of Invention

The present invention relates to a cleaning apparatus and, more particularly, to a cleaning apparatus for cleaning rod-shaped elements.

2. Related Prior Art

There are rod-shaped elements such as electrodes of batteries, threaded bolts and nuts. The electrodes of a battery inevitably get eroded because of oxidation and hence entail poor conductivity and inadequate contact with wires. Threaded bolts and nuts often get contaminated by dirt and water and hence rusted. It is difficult to disengage a rusted threaded bolt from a rusted nut.

Conventionally, a screwdriver is used to scratch rust or sandpaper is used to rub and wear rust for example. Such measures are ineffective and take long periods of time.

To solve this problem, a brushing apparatus has been devised to clean a battery as disclosed in U.S. Pat. No. 6,769,151. The brushing apparatus includes a C-shaped brush, a shell and a connective element. The C-shaped brush is inserted in the shell. The shell includes, on an internal side, a rib inserted in two ends of the C-shaped brush so that the C-shaped brush cannot be rotated relative to the shell. The connective element is inserted in the shell, against the C-shaped brush. A screw is used to secure the connective element to the shell to keep the C-shaped brush in the shell.

The C-shaped brush includes rows of bristle. The bristle tends to curl, deform and tangle after it is used to clean threaded bolts for example for some time. Such tangled bristle cannot clean effectively, and the used C-shaped brush must be replaced with a new one.

To this end, the screw is removed to allow the connective element to be detached from the shell. Not being stopped by the connective element, the C-shaped brush can be removed from the shell and replaced with a new C-shaped brush. Then, again, the connective element is inserted in the shell, against the C-shaped brush, and the screw is used to secure the connective element to the shell. Thus, the replacement is completed. The replacement is however complicated and takes a long period of time.

Taiwanese Patent M365294 discloses another brushing apparatus for cleaning a threaded bolt. This brushing apparatus also includes a C-shaped brush, a shell and a connective element. The shell and the connective element are made one. The shell includes an annular groove. The annular groove and the connective element are located at different ends of the shell. A C-shaped element is inserted in the annular groove, against the C-shaped brush. Thus, the C-shaped brush is kept in the shell.

When bristle of the C-shaped brush is worn and tangled, a special tool must be used to remove the C-shaped element from the annular groove to allow the C-shaped brush to be detached from the shell and replaced with a new one. However, such special tool is rare, and it is often difficult to find such special tool when it is needed. Alternatively, the entire brushing apparatus can be disposed of, and a new brushing apparatus can be bought. However, this is a waste of resources and imposes a problem for the environment.

US Patent Application Publication No. 2011/0005012 discloses another brushing apparatus that includes a C-shaped brush, a shell, a connective element and a cap. The cap is disengaged from the shell to allow removal of the C-shaped brush from the shell. The cap is engaged with the shell after a new C-shaped brush is inserted in the shell. The engagement of the cap with the shell must be firm lest the C-shaped brush would be cast out of the shell because of high-speed rotation in operation.

The present invention is therefore intended to obviate or at least alleviate the problems encountered in prior art.

SUMMARY OF INVENTION

It is the primary objective of the present invention to provide a cleaning apparatus that can easily be maintained.

To achieve the foregoing objective, the cleaning apparatus includes a supporting element, at least one button unit and a cleaning unit. The supporting element includes a space made in a front end. The button unit is formed on the supporting element by making, in the supporting element, a U-shaped slit that is in communication with the space. The button unit includes an elastic strip and a connective portion for connecting the elastic strip to the supporting element. The connective portion supports the elastic strip in the middle of the U-shaped slit and can be pivoted relative to the supporting element. The cleaning unit includes a shell, bristle and at least one hook. The shell is formed with a first end and a second end. The bristle is inserted in the shell through the first end of the shell. The hook extends from the second end of the shell. The hook is inserted deep into the space of the supporting element and then trapped in the U-shaped slit of the button unit as the cleaning unit is engaged with the supporting element. Now, the elastic strip is pivoted away from the supporting element by the hook. To disengage the cleaning unit from the supporting element, the button unit is operated to pivot the elastic strip toward the U-shaped slit to push the hook out of the U-shaped slit. Thus, the cleaning unit can be disengaged from the supporting element, and a new cleaning unit can rapidly and conveniently engaged with the supporting element.

The shell of the cleaning unit further includes an annular groove, a ring and a rib. The annular groove is made in an internal side of the shell, near the first end of the shell. The ring and the shell are made one, at the second end of the shell. The rib extends on the internal side of the shell in a longitudinal manner.

The cleaning unit further includes a C-shaped element and a ferrule. The C-shaped element includes two ends separated by a gap. The bristle is firmly connected to an internal side of the C-shaped element. As the C-shaped element is inserted in the shell via the first end of the shell, the rib is located between the ends of the C-shaped element to stop the C-shaped element from rotation relative to the shell. The ferrule is inserted in the annular groove of the shell. The ferrule and the ring abut against two opposite sides of the C-shaped element to keep the C-shaped element in the shell.

The supporting element further includes two ribs each extending on the internal side thereof so that the U-shaped slit is located between the ribs. The ribs guide the hook. Moreover, at least one arched strip extends from the second end of the shell. The arched strip and the hook are inserted deep in the space of the supporting element to allow the rib to enter a gap between the arched strip and the hook to prevent the shell from rotation in two directions relative to the supporting element.

The supporting element further includes a cavity made in a rear end to receive a connective unit. The connective unit can be connected to an electric, pneumatic or manual tool to cause the supporting element to rotate the cleaning unit in a same direction.

In an aspect, the connective unit is connected to the supporting element via a block and a recess. The block is formed on the wall of the cavity of the supporting element. The recess is made in an external side of the connective unit. The block is inserted in the recess as the connective unit is inserted in the cavity of the supporting element, thus keeping the connective unit in the supporting element.

In another aspect, the connective unit is connected to the supporting element via a groove and a fin. The groove is made in the wall of the cavity of the supporting element or the external side of the supporting element. The fin is formed on the external side of the connective unit or extends from the wall of the recess toward the connective unit. The fin is inserted in the groove as the connective unit is inserted in the cavity of the supporting element so that the connective unit and the supporting element can only be rotated together.

In another aspect, the connective unit is connected to the supporting element via a square extension and a second square cavity. The square extension is formed on the internal side of the cavity. The second square cavity is made in an end of the connective unit. The square extension is inserted in the second square cavity of the supporting element as the connective unit is inserted in the cavity of the supporting element so that the connective unit and the supporting element can only be rotated together.

Other objectives, advantages and features of the present invention will become apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
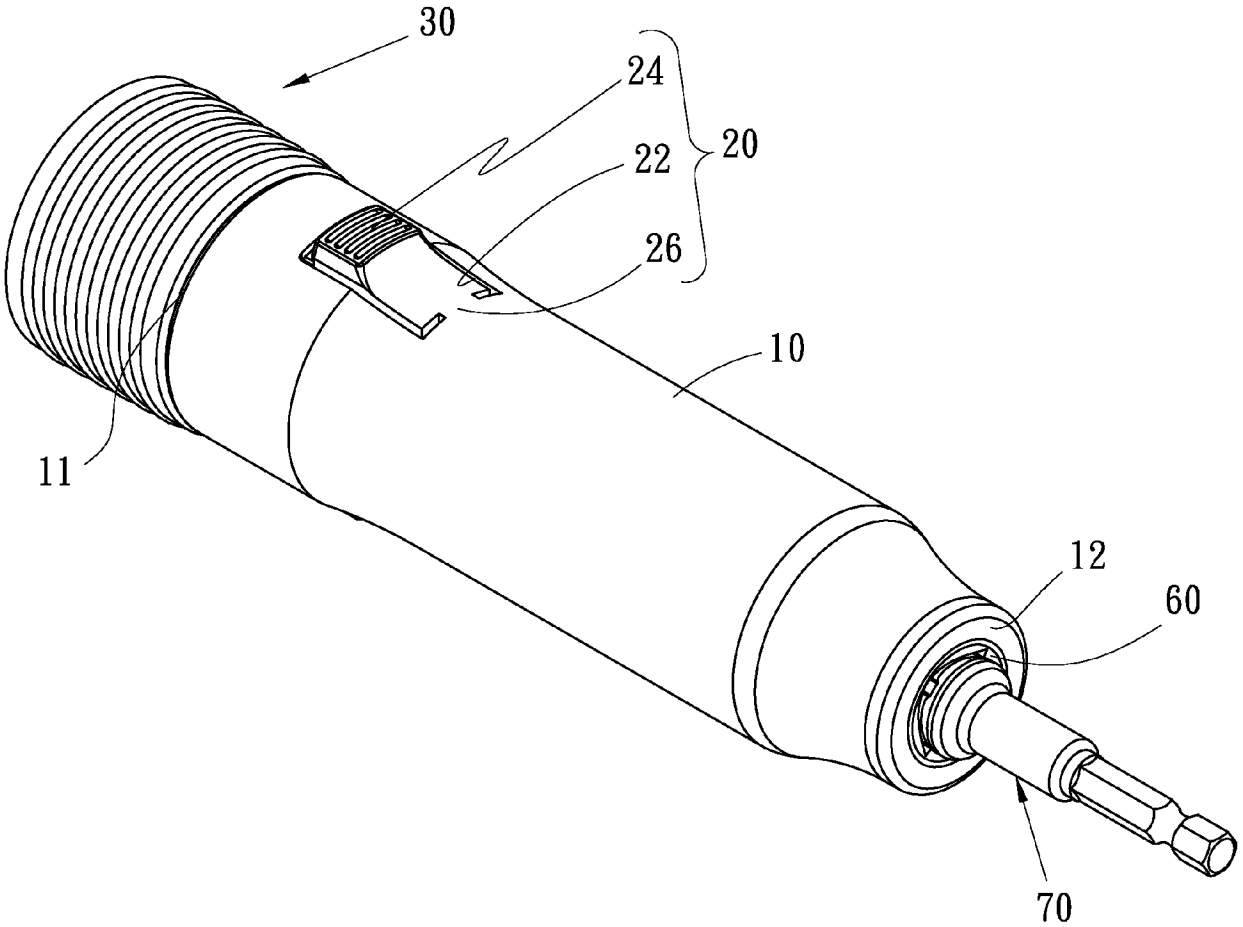
FIG. 1 is a perspective view of a cleaning apparatus according to the first embodiment of the present invention.
Figure 2:
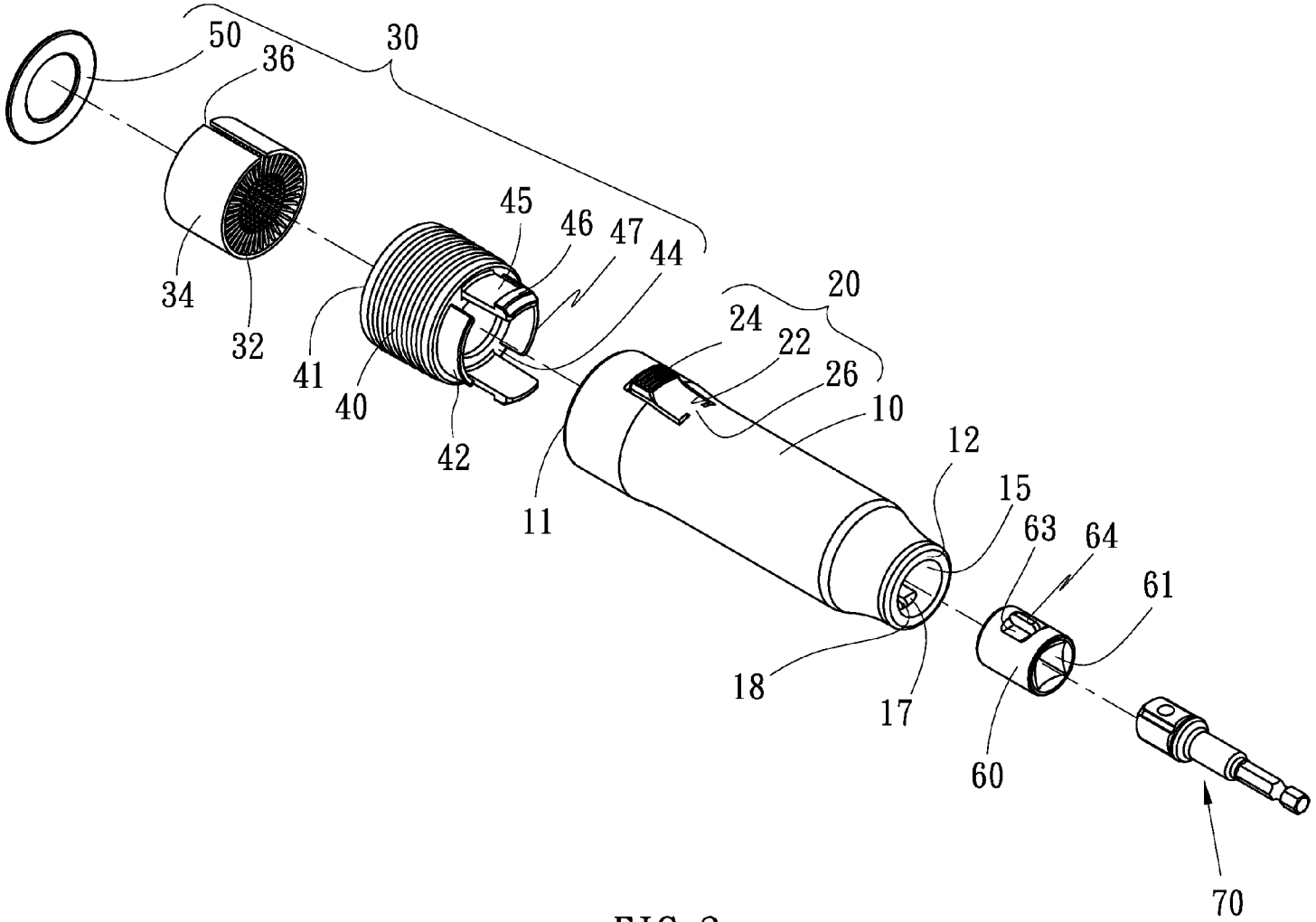
FIG. 2 is an exploded view of the cleaning apparatus illustrated in FIG. 1.
Figure 3:
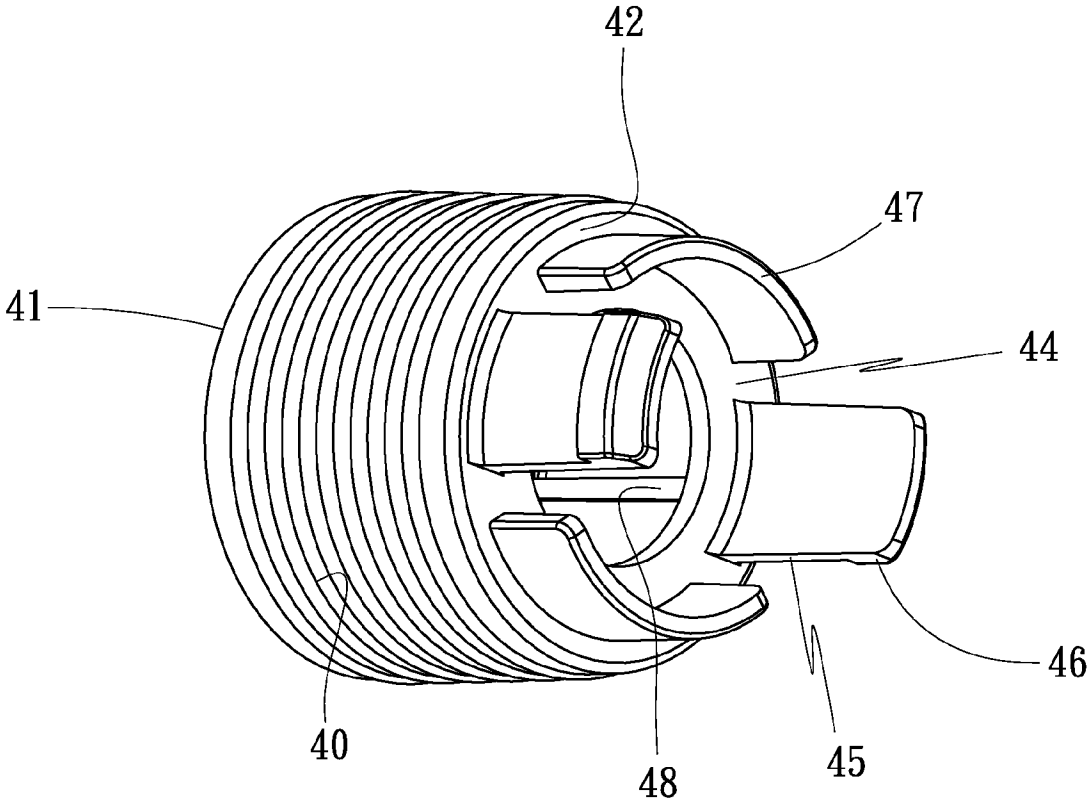
FIG. 3 is a perspective view of a shell of the cleaning apparatus shown in FIG. 1.
Figure 4:
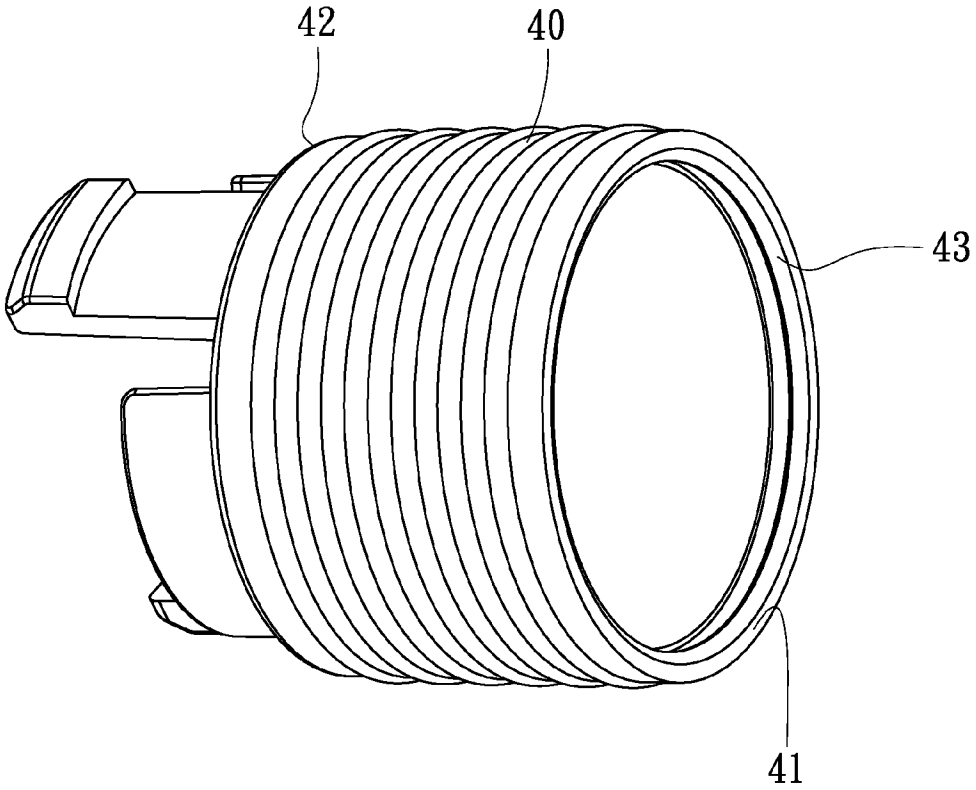
FIG. 4 is another perspective view of the shell shown in FIG. 3.

Referring to FIG. 1, a cleaning apparatus includes a supporting element 10, two button units 20 and a cleaning unit 30 according to the present invention. The cleaning apparatus is devised for cleaning a rod-shaped element such as a threaded bolt.

Figure 5:
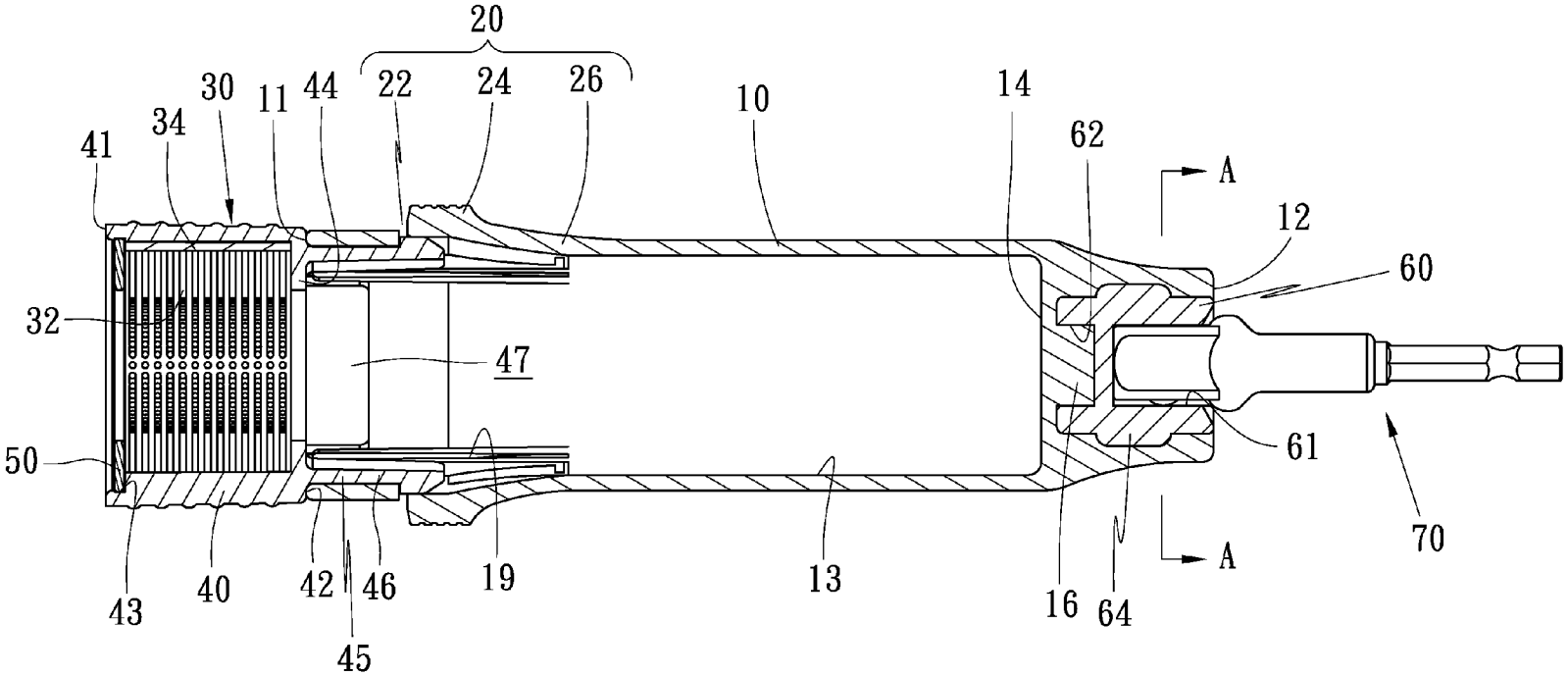
FIG. 5 is a cross-sectional view of the cleaning apparatus shown in FIG. 1.
Figure 6:
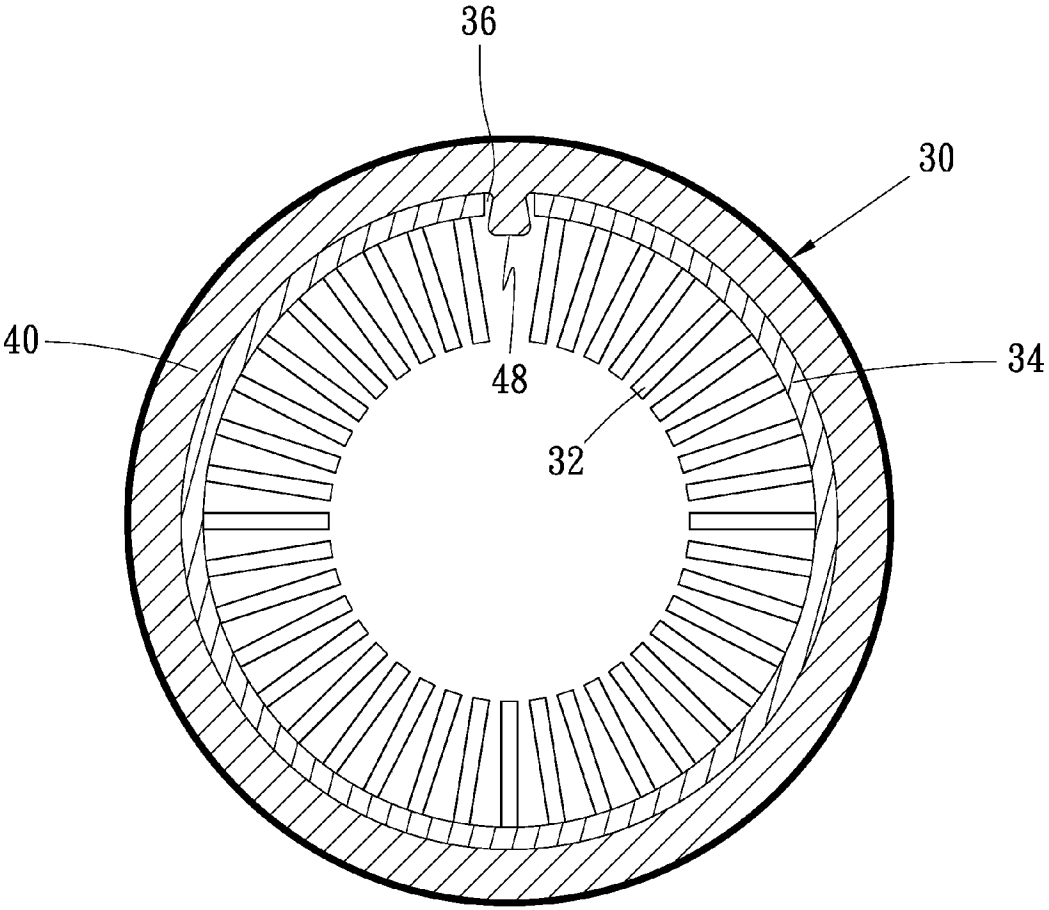
FIG. 6 is a cross-sectional view of a cleaning unit of the cleaning apparatus shown in FIG. 1.
Figure 7:
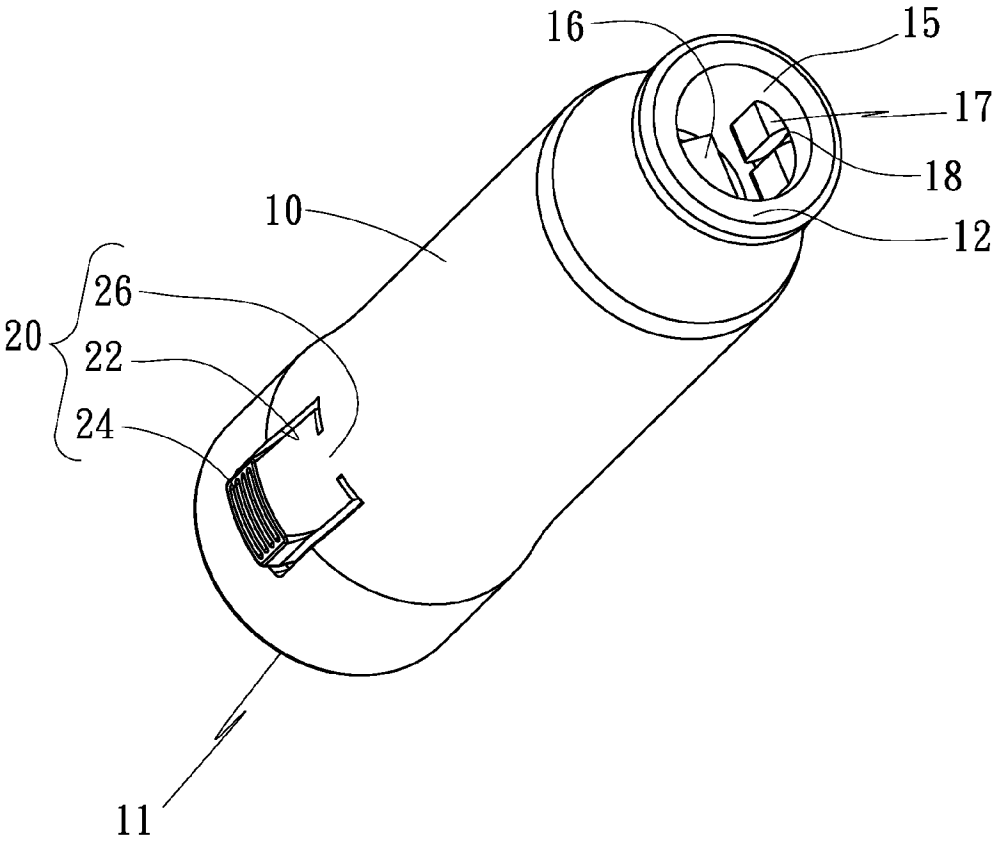
FIG. 7 is a perspective view of a supporting element of the cleaning apparatus shown in FIG. 1.
Figure 8:
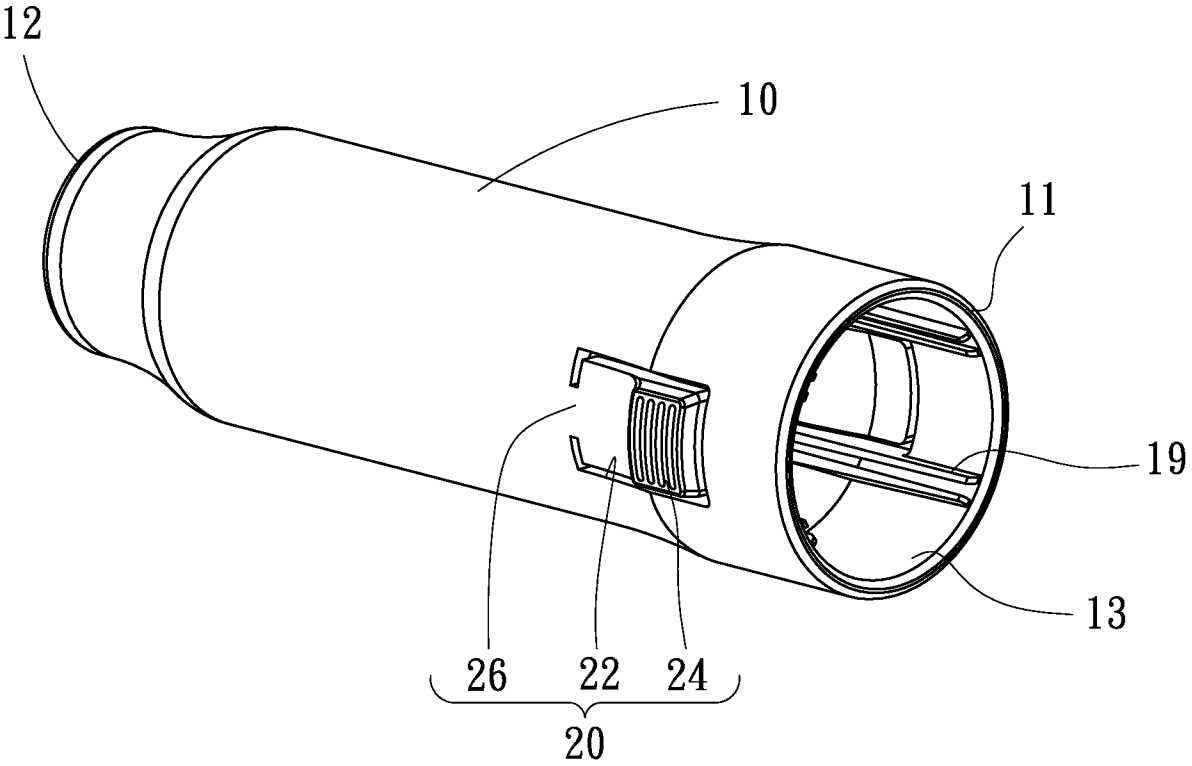
FIG. 8 is another perspective view of the supporting element shown in FIG. 7.
Figure 9:
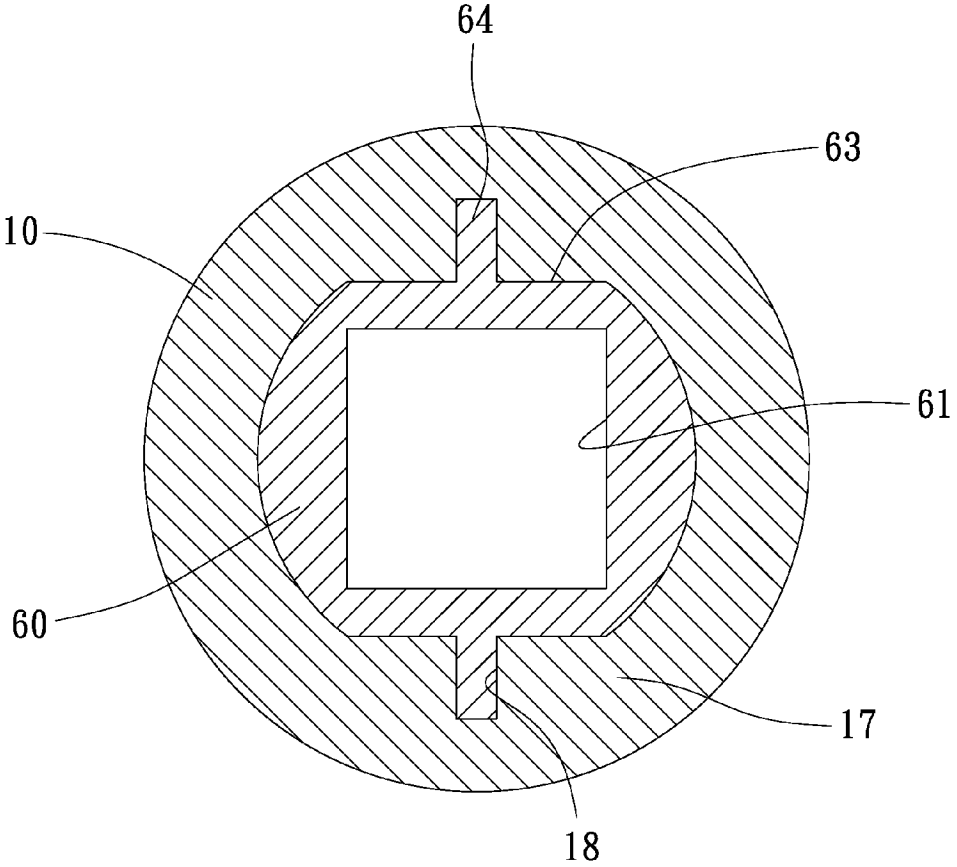
FIG. 9 is a cross-sectional view taken along a line A-A in FIG. 5.

Referring to FIGS. 5, 7 and 8, the supporting element 10 is a cylindrical element made of a non-metal material. The supporting element 10 includes a front end 11 and a rear end 12. A space 13 is made in the front end 11 of the supporting element 10. The space 13 includes a closed end 14. A cavity 15 is made in the rear end 12 of the supporting element 10.

Each of the button units 20 is formed on the supporting element 10 by making a substantially U-shaped slit 22 in the supporting element 10. The U-shaped slit 22 is made throughout the supporting element 10 in a radial direction and in communication with the space 13. Each button unit 20 includes an elastic strip 24 and a connective portion 26 for connecting the elastic strip 24 to a portion of the supporting element 10 near the space 13. The elastic strip 24 can be pivoted relative to the supporting element 10.

The supporting element 10 further includes four pairs of ribs 19 extending on an internal side that extends around the space 13. The pairs of ribs 19 extend from the front end 11 of the supporting element 10 toward the closed end 14 of the space 13. Each of the U-shaped slits 22 includes two lateral sections each located next to a corresponding pair of ribs 19. The supporting element 10 can include four ribs 19 each extending along and next to a corresponding lateral section of a corresponding one U-shaped slit 22 in another embodiment.

A lining 60 includes two square cavities 61 and 62 respectively made in two opposite ends. The lining 60 is inserted in the cavity 15 so that the cavity 61 is exposed to the exterior of the cavity 15.

An axle 70 includes a square end and a hexagonal end for example. The square end can be inserted in the square cavity 61. The hexagonal end of the axle 70 can be inserted in a receptacle of an electric, pneumatic or manual tool. Thus, the electric, pneumatic or manual tool can rotate the supporting element 10 via the axle 70.

The lining 60 and the axle 70 are two separate elements that can be connected to each other in the first embodiment. However, the lining 60 and the axle 70 can be made one in another embodiment.

The lining 60 includes, in an external side, a recess 63 for receiving a block 17 formed on the wall of the cavity 15. The lining 60 is kept in the supporting element 10 since the block 17 is inserted in the recess 63.

The lining 60 is formed with a fin 64 in the recess 63. The fin 64 extends in a longitudinal direction of the lining 60. The block 17 is made with a groove 18 for receiving the fin 64 as the block 17 is inserted in the recess 63. Thus, the synchronous rotation of the lining 60 and the supporting element 10 is ensured.

The supporting element 10 further includes a square extension 16 in the cavity 15. The square extension 16 is inserted in the square cavity 62 as the lining 60 is inserted in the cavity 15. Thus, the synchronous rotation of the lining 60 and the supporting element 10 is further ensured.

Referring to FIGS. 2 to 6, the cleaning unit 30 includes bristle 32, a C-shaped element 34, a shell 40 and a ferrule 50. The bristle 32 is arranged in rows on an internal side of the C-shaped element 34. The C-shaped element 34 includes two ends separated from each other by a gap 36. The shell 40 is formed with a first end 41, a second end 42 and a rib 48. The rib 48 extends on an internal side of the shell 40 in a longitudinal manner. Two ends of the rib 48 point at the first end 41 and the second end 42 of the shell 40.

The shell 40 further includes an annular groove 43, a ring 44, two hooks 45 and two arched strips 47. The annular groove 43 is made in the internal side of the shell 40, near the first end 41 of the shell 40. The ring 44 and the ferrule 50 are annular elements. The ring 44 is formed on the second end 42 of the shell 40, i.e., the ring 44 and the shell 40 are made one. Each of the hooks 45 extends from the second end 42 of the shell 40. Each of the hooks 45 includes a barb 46 formed at an external end. Each of the arched strips 47 extends from the second end 42 of the shell 40. The arched strips 47 and the hooks 45 are arranged in an alternate manner. The arched strips 47 are separated from the hooks 45 by gaps (not numbered).

As the C-shaped element 34 is inserted in the shell 40 via the first end 41, the rib 48 is located between the ends of the C-shaped element 34, thus preventing rotation of the C-shaped element 34 relative to the shell 40. The ferrule 50 is inserted in the annular groove 43 of the shell 40. The ferrule 50 and the ring 44 are abutted against two opposite sides of the C-shaped element 34, thus keeping the C-shaped element 34 and the bristle 32 in the shell 40.

As the supporting element 10 is engaged with the cleaning unit 30, the hooks 45 and the arched strips 47 are inserted in the space 13 of the supporting element 10. Thus, the shell 40 and the supporting element 10 are coaxial with each other.

The ribs 19 guide the hooks 45 into the U-shaped slits 22 so that the elastic strips 24 are pivoted outward by the barbs 46. Now, the arched strips 47 and the ribs 19 are arranged in an alternate manner. That is, the ribs 19 are inserted in the gaps between the arched strips 47 and the hooks 45. Thus, the connection of the cleaning unit 30 to the front end 11 of the supporting element 10 is enhanced, and the shell 40 is prevented from rotation in two opposite directions relative to the supporting element 10.

The space 13 of the supporting element 10 is in communication with the interior of the shell 40 to receive a rod-shaped element such as a threaded bolt. The bristle 32 cleans the threaded bolt by when the supporting element 10 rotates the C-shaped element 34 via the shell 40.

To disengage the cleaning unit 30 from the supporting element 10, the button units 20 are operated to move the hooks 45 out of the U-shaped slits 22. Briefly speaking, the elastic strips 24 are pivoted toward an axis (not numbered) of the shell 40 to move the barbs 46 out of the U-shaped slits 22. That is, the hooks 45 are moved out of the U-shaped slits 22. Now, the cleaning unit 30 can be disengaged from the supporting element 10, and a new cleaning unit 30 can rapidly and conveniently be engaged with the supporting element 10.

Alternatively, a tool (not shown) can be used to move the ferrule 50 out of the annular groove 43 of the shell 40. Thus, the C-shaped element 34 and the bristle 32 can be removed from the first end 41 of the shell 40. A new C-shaped element 34 can be inserted in the first end 41 of the shell 40 before the ferrule 50 is inserted in the annular groove 43 of the shell 40 again.

Figure 10:
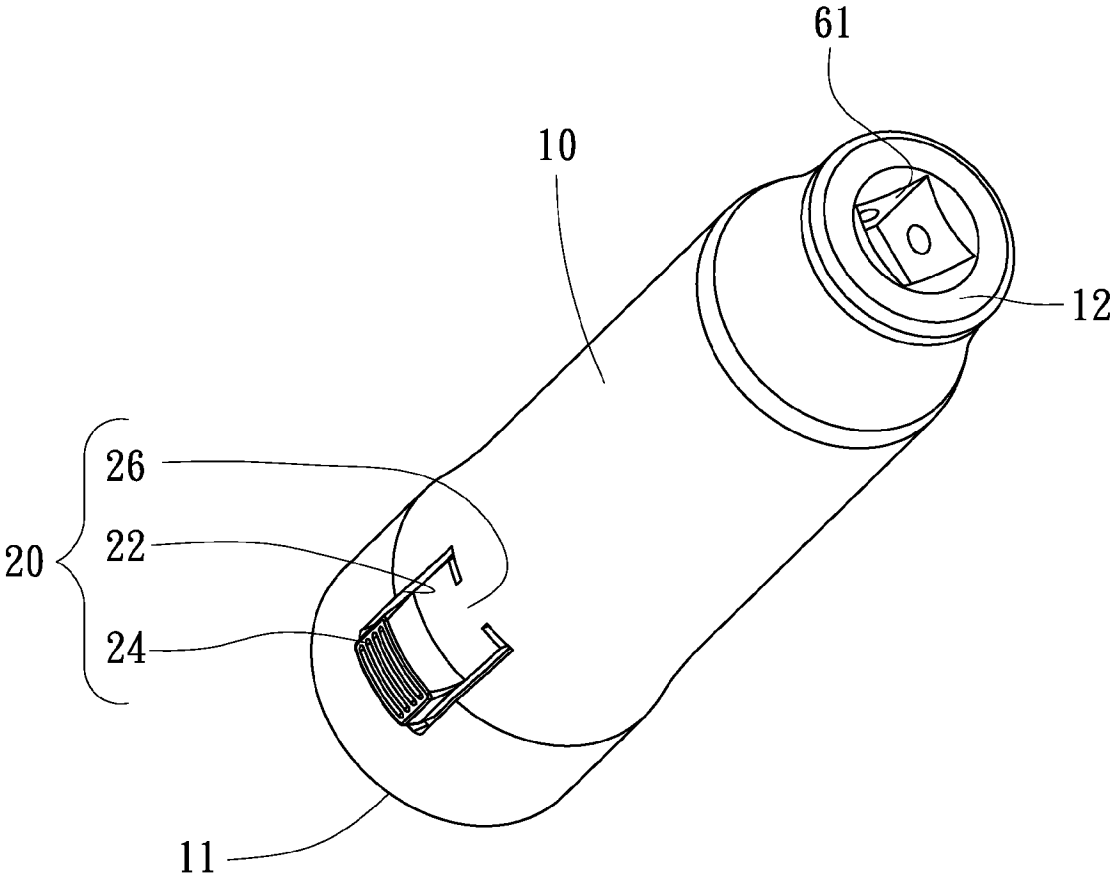
FIG. 10 is a perspective view of a supporting element of a cleaning apparatus according to the second embodiment of the present invention.

Referring to FIG. 10, there is a cleaning apparatus according to a second embodiment of the present invention. The second embodiment is identical to the first embodiment except for several features. Firstly, there is no connective unit. Secondly, the square cavity 61 is made in the rear end 12 of the supporting element 10.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cleaning apparatus comprising:

a supporting element comprising a space made in a front end;

at least one button unit formed on the supporting element by making a substantially U-shaped slit in the supporting element, wherein the substantially U-shaped slit is in communication with the space;

a cleaning unit comprising:

a shell comprising a first end and a second end;

bristle connected to an internal side of the shell via the first end; and at least one hook extending from the second end of the shell, wherein the hook is inserted in the space of the supporting element and the substantially U-shaped slit of the button unit to engage the cleaning unit with the supporting element, wherein the button unit is operable to move the hook out of the substantially U-shaped slit to allow disengagement of the cleaning unit from the supporting element.

2. The cleaning apparatus according to claim 1, wherein the button unit further comprises an elastic strip and a connective portion for connecting the elastic strip to a portion of the supporting element located in the substantially U-shaped slit, wherein the elastic strip can be pivoted relative to the supporting element.

3. The cleaning apparatus according to claim 1, wherein the supporting element further comprises ribs each extending next to and along a lateral section of the U-shaped slit in the space, wherein the hook is guided by the ribs while the hook is inserted into the space.

4. The cleaning apparatus according to claim 1, wherein the supporting element further comprises a square cavity made in a rear end to receive a square portion of a rotating tool.

5. The cleaning apparatus according to claim 1, wherein the supporting element further comprises:

a cavity made in a rear end; and a connective element inserted in the cavity so that the connective element is rotatable together with the supporting element, wherein the connective element comprises a first square cavity for receiving a square portion of a rotating tool.

6. The cleaning apparatus according to claim 5, wherein the supporting element is further formed with a block in the cavity, wherein the connective element further comprises a recess made in an external side of the connective element, wherein the block is inserted in the recess as the connective element is inserted in the cavity of the supporting element, thus keeping the connective element in the supporting element.

7. The cleaning apparatus according to claim 6, wherein the supporting element further comprises a groove made in the block, wherein the connective element is further formed with a fin in the recess, wherein the fin extends in a longitudinal direction of the connective element, wherein the fin is inserted in the groove as the connective element is inserted in the cavity of the supporting element, thus preventing rotation of the connective element relative to the supporting element.

8. The cleaning apparatus according to claim 5, wherein the connective element further comprises a second square cavity made therein, wherein the supporting element further comprises a square extension inserted in the second square cavity of the connective element as the connective element is inserted in the cavity of the supporting element, thus preventing rotation of the connective element relative to the supporting element.

9. The cleaning apparatus according to claim 1, wherein the shell further comprises:

an internal side;

an annular groove made in the internal side of the shell, near the first end;

a ring formed on the internal side of the shell, near the second end;

a rib formed on the internal side of the shell in a longitudinal manner;

a C-shaped element comprising two ends separated by a gap, wherein the bristle is connected to an internal side of the C-shaped element, wherein the rib is located between the ends of the C-shaped element as the C-shaped element is inserted in the shell via the first end, thus preventing rotation of the C-shaped element relative to the shell; and a ferrule inserted in the annular groove of the shell, wherein the ferrule and the ring are abutted against two opposite sides of the C-shaped element to keep the C-shaped element in the shell.

10. The cleaning apparatus according to claim 1, wherein the shell further comprises at least one arched strip formed at the second end and inserted in the space of the supporting element.

* * * * *